US005896013A

United States Patent [19]

Leskovec

[11] Patent Number: 5,896,013

[45] Date of Patent: Apr. 20, 1999

[54] OPERATING CIRCUIT FOR AN INDUCTIVELY BALLASTED ARC DISCHARGE LAMP

[75] Inventor: Robert A. Leskovec, Richmond Heights, Ohio

[73] Assignee: Advanced Lighting Technologies, Inc., Solon, Ohio

[21] Appl. No.: 08/600,262

[22] Filed: Feb. 12, 1996

[51] Int. Cl.[6] ..... H05B 37/00

[52] U.S. Cl. ..... 315/171; 315/172; 315/DIG. 5; 315/289

[58] Field of Search ..... 315/289, 176, 315/175, 160, 170, 174, 244, DIG. 2, DIG. 5, 171, 172

[56] References Cited

U.S. PATENT DOCUMENTS 3,866,088 2/1975 Kaneda et al. ..... 315/105

4,353,011 10/1982 Kaneda ..... 315/240

4,484,107 11/1984 Kaneda ..... 315/176

4,890,041 12/1989 Nuckolls et al. ..... 315/225

*Primary Examiner*—Don Wong

*Assistant Examiner*—David H. Vu

*Attorney, Agent, or Firm*—Rogers & Killeen

[57] ABSTRACT

Ballast circuitry for a metal halide lamp is disclosed enabling sustained operation with a typical 120 volt AC power source. A novel auxiliary circuit network is operatively associated with inductive type starting circuit means to provide lamp reignition when needed during each half-cycle of the AC power supply. The present auxiliary circuit network employs breakover switching means connected in series with capacitor storage means for further connection across the operating discharge lamp.

25 Claims, 1 Drawing Sheet

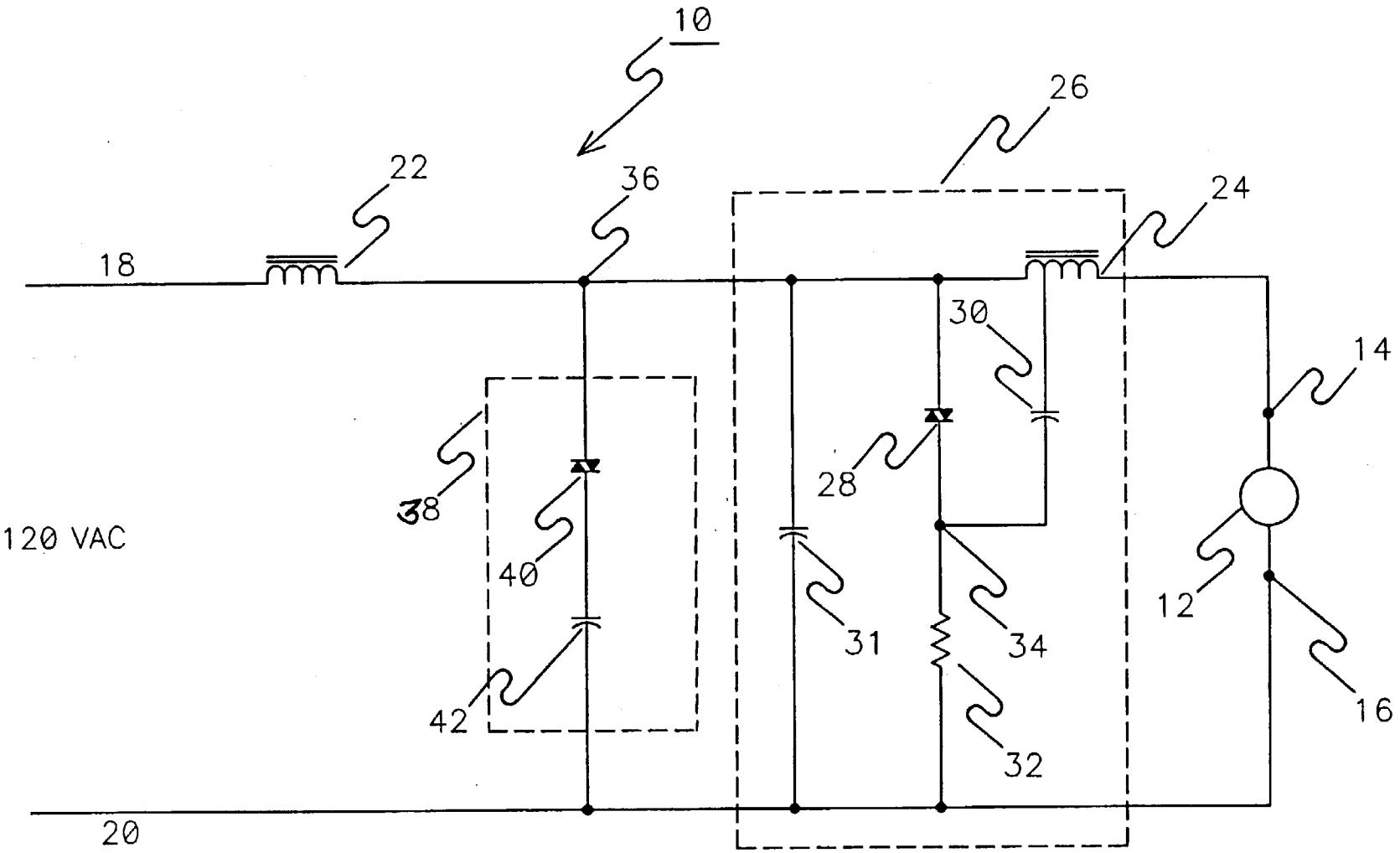
10
12
14
16
18
20
22
24
26
28
30
31
32
34
36
38
40
42
120 VAC

OPERATING CIRCUIT FOR AN INDUCTIVELY BALLASTED ARC DISCHARGE LAMP

BACKGROUND OF THE INVENTION

This invention relates generally to an improved ballast circuitry for metal halide arc discharge lamps enabling sustained operation from a typical 120 volt 60 Hz AC power source and, more particularly, to simplified operating circuit means for so doing.

Conventional metal halide type arc discharge lamp operation can be characterized as successively requiring (1) an initial high voltage breakdown mode, (2) a glow-to-arc transition mode, and (3) a steady state run mode. The already known overall ballast circuitry includes means to provide typical 2–4 kilovolts to achieve initial breakdown, and means which then must continue to provide sufficient "open circuit voltage" (OCV) to exceed that of the lamp, backed up with sufficient current to cause the lamp to proceed into the arc condition. Once the arc tube in such AC operated lamps is in the arc mode, the arc must reignite at the beginning of each half-cycle of the AC power supply. During the warm-up process the voltage required to reignite commonly employed lamps on each half-cycle rises for a period of time until the arc stablizes. If the current flowing in the arc tube drops below a critical value, the arc condition may extinguish causing the arc tube to revert to its glow-to-arc mode or even the initial breakdown mode. The reestablishment of the desired arc condition may therefor require high voltage for breakdown and a source of glow-to-arc transition energy on an immediate cycle by cycle basis. As a result, such AC operated metal halide arc discharge lamps are operated from a supply voltage in the range 240–277 volts which is high enough to provide the OCV and meet the reignition requirements. In such conditions, the starting circuit portion of the overall circuitry need only provide high voltage sufficient for breakdown in the arc tube. The power line is higher than the lamp terminal voltage (215 volts typical OCV) enough of each half-cycle to cause sufficient current to flow in the lamp run circuitry and establish the required arc, limited by the impedance of a single inductor.

When it is desired to operate such a ballasted lamp with a typical 120 volt rms AC power supply, however, the line voltage does not meet the minimum OCV and some other means must be provided to get through the glow-to-arc transition. Once in the run mode, the lamp terminal voltage becomes much lower than the supplied line voltage so the lamp is able to operate thereafter from such 120 volt AC power supply in series with the suitable current-limiting means. In a DC circuit, the required OCV can be obtained from a relatively simple voltage doubler, but for an AC circuit, some other solution must be provided. For example, the series inductor can be in the form of a step-up auto transformer but this is bulky as well as heavy and wasteful in terms of additional energy dissipation from this circuit component. Typically such circuit component remains in the ballast circuitry during lamp operation but the step-up part is not really needed once the transition to the run mode is made.

Already known ballast circuit means enabling sustained 120 volt AC operation of the arc discharge lamp but which further employs an incandescent lamp filament is disclosed in U.S. Pat. No. 4,555,647, filed in the name of the present inventor and others. As therein described, the operating circuitry discharges energy stored in a multiple capacitor arrangement as the voltage applied to the arc tube transitions to its low value and supplies or controls the necessary energy applied to the arc tube to prevent the extinction of the arc condition in the arc tube during the steady state run mode of operation. The ballast circuitry controlling the steady state run mode of operation of the arc tube is effectively in parallel with the arc tube and incandescent filament arrangement until the ballast circuit is rendered conductive at which time the ballast circuit discharges, in a serial manner, the energy stored in its capacitor devices into the arc tube and filament arrangement. The specific circuit arrangement described for doing so employs starting circuit means being operated in combination with a pair of multicomponent biasing circuit networks for the required switching action. The auxiliary circuit network said therein to be required for such cooperation with the starting means includes (a) capacitive energy storage means comprising a first capacitor and a second capacitor each provided with means connected to one end thereof for respectively charging each of said first and second capacitors during a preselected portion of the said applied AC voltage and with each of said first and second capacitors having the other end thereof connected respectively to an opposite input terminal of said operating circuit, (b) switching means comprising first and second current control devices each having a first, a second and a third terminal, (c) a first bias network and a second bias network respectively connected to said first terminal of each of said first and second current control device, said first and second bias networks being respectively responsive to a selected portion of the cycle of said AC voltage effective to respectively render said first and second current control devices conductive, and (d) said first and second current control devices each respectively having a second terminal connected to opposite terminals of said output stage, and each of said first and second current control devices having its third terminal respectively connected to said first end of said first and second capacitors effective to respectively discharge said first and second capacitors across the gas discharge tube when said first and second current control devices are rendered conductive.

It remains desirable to provide still more effective and simpler ballasting circuitry for sustained operation of a metal halide type arc discharge lamp from a 120 volt AC power supply.

Accordingly, a novel operating circuit arrangement for sustained lamp operation has now been discovered which continuously maintains the desired run mode condition in the arc tube being employed with a minimum number of required circuit components.

Another object of the present invention is to provide operating circuitry for a metal halide arc discharge lamp which operates in a novel manner also effecting energy conservation.

Still another object of the present invention is to provide operating circuitry for a metal halide arc discharge lamp wherein a pair of circuit components enables relaxation type starting circuit means to provide the glow-to-arc transition in the lamp being operated, then automatically switches to a different mode to supply reignition energy when needed in the arc tube, and finally becomes inactive in the circuit arrangement once the run mode has been reestablished, thereby dissipating no further energy.

These and other objects of the present invention, both as to circuit construction and method of operation, may best be understood by reference to the following description taken in conjunction with the accompanying drawing

SUMMARY OF THE INVENTION

It has now been determined, surprisingly, that a novel circuit arrangement enables sustained operation of a metal halide arc discharge lamp from a 120 volt AC power supply in the foregoing manner. The required overall lamp unit employs a metal halide arc discharge lamp connected in series with current-limiting induction means across the 120 volt AC power supply, starting circuit means connected in parallel across said arc discharge lamp enabling lamp ignition, and an auxiliary circuit network operatively associated therewith to automatically enable lamp reignition when needed during each half-cycle of the AC power supply, said auxiliary circuit network including breakover switching means connected in series with capacitor storage means across said discharge lamp and with said capacitor storage means being connected for resonant cooperation with the current-limiting induction means to supply the high voltage required for lamp reignition. For a representative circuitry embodiment of the present invention, the breakover switching means being utilized in the auxiliary circuit network is a 105 volt SIDAC device connected in series with an AC capacitor having a 6 microfarad value. A suitable relaxation-type starting circuit means for said embodiment includes a second 120 volt SIDAC switching device, a 0.1 microfarad AC capacitor, a charging resistor for said capacitor having a 10K ohm value and a rating of five watts, and a ferrite-core pulse transformer accommodating passage of the lamp run current with sufficiently low inductance and resistance so as not to impede impulse currents occurring during the lamp starting process. Suitable current-limiting induction means for the herein illustrated lamp unit can be a choke coil or like device having a 200 millihenries value. During operation, the AC capacitor means being employed in the present auxiliary circuit network interacts with the disclosed induction means to develop a high voltage exceeding the minimum OCV requirement of the lamp being operated and thereby provides sufficient energy for the glow-to-arc transition. The illustrated 105 volt SIDAC device in said auxiliary network controls charging and discharging of said capacitor enabling needed energy to be discharged to the lamp at the proper time during each half-cycle of applied power. Once the lamp is ignited and operated in a stable arc mode, both SIDAC devices in the illustrated operating circuitry assume a non-conductive state thereby effectively disconnecting the circuit components connected thereto and leaving a run circuit comprising only the arc lamp and the series connected induction means. Still further details respecting construction as well as operation of the herein representative lamp unit are provided hereinafter in the following description of preferred embodiments taken in conjunction with the accompanying drawing.

BRIEF DESCRIPTION OF THE DRAWING

The accompanying drawing is a schematic circuit diagram for a representative metal halide arc discharge lamp employing the operating circuitry of the present invention

DETAILED DESCRIPTION OF THE PREFERRED EMBODIMENTS

The accompanying drawing is an electrical schematic diagram depicting a typical 50 watt metal halide arc discharge lamp unit 10 employing a representative ballast or operating circuitry according to the present invention. Accordingly, said arc discharge lamp 12 includes conventional terminals 14 and 16 connected to accept a 120 volt rms 60 Hz AC power source applied across input terminals 18 and 20 of said power source. Current-limiting induction coil 22 and a ferrite core pulse transformer 24 are connected in series intermediate input terminal 18 of the power source and terminal 14 of the lamp. The series circuit thus described constitutes the run circuit for said lamp unit where the run circuit is limited and held substantially constant by the reactance of the inductor component 22. In doing so, the illustrated ferrite core starting transformer 24 is designed to accommodate the lamp run current that passes through it and has inductance and resistance that is sufficiently low so as not to impede impulse currents that flow during the lamp's starting process. The particular relaxation-type starting circuit means 26 being depicted in the herein illustrated operating circuitry embodiment further includes first breakover switch means 28 consisting of a 120 volt bidirectional SIDAC device, capacitor 30 having a 0.1 microfarad and 400 volt rating, and charging resistor 32 having a value of 10K ohms and a 5 watt rating for operative association with the depicted starting transformer 24. In so doing, it can be seen that one terminal of capacitor 30 is connected to an intermediate tap terminal of starting transformer 24 whereas its remaining terminal is connected to a first common node 34 provided in the illustrated embodiment which further connects to charging resistor 32 while also being commonly connected to input terminal 20 of the power supply. Remaining capacitor 31 in the starting circuit 26 is connected in parallel across the lamp terminals with one terminal being connected to a second common node 36 further connecting one terminal of SIDAC device 28 in the illustrated circuit embodiment. This starting circuit arrangement enables charging of capacitor 30 by current flow through resistor 32 until the voltage across said capacitor exceeds the breakdown voltage of SIDAC device 28 whereupon the latter device switches from a non-conducting to a conducting state causing capacitor 30 to discharge through the tapped portion of the winding in transformer 24. This action causes a high voltage pulse to be generated across the entire winding of transformer 24 with capacitor 31 forming a low impedance path enabling said high voltage pulse to produce the initial breakdown mode of lamp operation.

An auxiliary circuit network 38 is included in the herein illustrated operating circuit embodiment for interaction as needed to enable lamp reignition while also automatically dropping out of the circuit operation once the lamp is running so as to avoid additional energy dissipation. As such, the auxiliary circuit network comprises a second breakover switch means 40 consisting of a 105 volts bidirectional SIDAC device being series connected to a storage capacitor 42 having a 6 microfarads and 400 volt rating for interaction of said circuit arrangement with induction coil 22 during lamp operation. For this purpose, said auxiliary circuit network is connected in parallel across the lamp terminals by having one end being connected to said second common node 36 in the overall operating circuitry while being connected at the other end to second input terminal 20 of the AC power supply. The resulting circuit arrangement has breakover switch 40 connected at one end to common circuit node 36 while being connected at the other end to a first terminal of capacitor 42 and with the second terminal of said capacitor being connected to the power supply terminal 20. Having the auxiliary circuit network connected in such manner continuously provides glow-to-arc transition energy to the operating lamp while automatically switching to a different mode of circuit operation supplying reignition energy if needed and finally dropping out of the circuit operation once the lamp has achieved a steady-state run mode. Such glow-to-arc transition energy is provided with the AC capacitor 42 which interacts with the induction coil 22 to resonate near the power supply frequency so that a high voltage develops across said capacitor exceeding the minimum OCV requirement for continued lamp operation. Charging and discharging of capacitor 42 so that the stored energy is discharged into the operating lamp at the proper time during each half-cycle of applied AC power source is controlled by breakover switch 40.

A still more detailed explanation is now provided respecting operation of the present inter-active auxiliary circuit network. For the 50 watt size metal halide arc discharge lamp being operated from a 120 volt rms AC power source, a 105 volt breakover switch is selected but said device may be any suitable device or circuit subassembly capable of conducting current in both directions when the voltage applied across its terminals exceeds a predetermined voltage threshold and with said device remaining conductive thereafter for a predetermined time period less than or equal to that time where the current through it goes to zero, and thereupon reverts to a non-conductive state until such time as the voltage across its terminals again exceeds the breakover value, that value being in the range of 50–250 volts depending upon the requirements of the particular circuit involved. Capacitor 42 in said auxiliary circuit network interacts with induction coil 22 in a resonance circuit operating below resonance but sufficiently close to resonance such that a large voltage develops across said capacitor device. Developed voltage exceeds the OCV requirement of the lamp being illustrated and causes said lamp to go into an arc condition but, additionally, capacitor 42 is sized to discharge sufficient stored energy into the lamp to instantly establish an appropriate magnitude of sustaining arc current. When power is initially applied to the overall operating circuit, the switch 40 is non-conductive and capacitor 42 is uncharged. Before breakdown, no substantial current flows through the inductor means 22 so that the voltage at common node 36 in the overall lamp operating circuit follows that of the applied line voltage. Within a cycle, however, line voltage exceeds that of capacitor 42 by an amount equal to the switch breakover voltage, in this case, equal but not limited to a value of 105 volts, and switch 40 becomes conductive until the current through it goes to zero. However, once capacitor 42 is connected into the circuit, it forms a resonance circuit with the inductor means 22 and current flows from the applied power source. The voltage across said capacitor lags the current through it by approximately 90 degrees. At such time when the current through the switch 40 goes to zero, which is an effect of the current through the inductor means going to zero, said switch becomes non-conductive. However, the voltage across it immediately reverts to a large value due to the charge having just been stored in capacitor 42 and the switch again becomes conductive. Thus, for that time before the lamp breaks down, the switch is caused to be conductive for a majority of each half-cycle and the current and voltage relationships are substantially the same as they would be for inductor means 22 and capacitor 42 operating below resonance. Specifically for typical values of inductance equal to the 200 millihenries in the selected inductor means 22, and capacitance of 6 microfarads in capacitor 42, the resonance frequency is 145 Hertz and the circuit is operating at the power source frequency of 60 Hertz. At this much below resonance the voltage on capacitor 42 at common node 36 in the overall operating circuitry relative to voltage of the applied power source lags only a few degrees, but reaches a peak value of 270 volts well in excess of the typical 214 volts OCV requirement of the herein illustrated lamp. The voltage at common node 36 is the same as that which appears across the relaxation type starting circuit means 26 which produces 4–5 voltage pulses per half-cycle. When the arc tube undergoes breakdown from one of these pulses, it is during the same part of the cycle where capacitor 42 is charged equal or close to its peak value, above the OCV requirement of the operating lamp and is therefore able to immediately follow up by discharging a sizable current into said lamp and thereby aid in the establishment of a lamp arc condition. Once the lamp goes into arc, the terminal voltage drops at common node 36 below that of switch 40 so that the latter reverts to a non-conductive state, disconnecting capacitor 42 from the operating circuit. If, during warm-up, the lamp undergoes an operating mode wherein the reignition voltage rises, switch 40 fires and charges capacitor 42. However, the current through the capacitor leads the voltage. Once the current goes to zero the voltage on said capacitor is at the peak, and the switch 40 becomes non-conductive. Switch 28 in starting circuit 26 also comes back on and the current going to starting circuit means 26 pulls common node 36 down from the peak just established (at approximately 300 volts peak), and within several milliseconds down to approximately 195 volts, causing a difference (of approximately 105 volts) to again trigger switch 40, but this time the current flows out of capacitor 42 into the load. During such time period the direction of current flow is from input terminal 18 through the inductor coil 22 to common node 36 so that when switch 40 goes into conduction as just described, and since the current through said inductor means cannot change instantaneously, the current from capacitor 42 can only go in the direction of the operating lamp. The starting circuit means 26 keeps making pulses, and as soon as one of them causes reignition, capacitor 42 rapidly discharges into the lamp, thereby reestablishing a stable arc condition. This process occurs as needed, equally well on both half-cycles of applied powers, since all the components operate symmetrically. As further previously indicated respecting overall circuit operation in this manner, once the operating lamp has achieved a stable run mode, both switches 28 and 40 remain non-conductive thereby effectively disconnecting the circuit components connected thereto for decreased energy utilization.

It will be apparent from the foreging description that broadly useful and improved operating circuitry means have been provided to operate metal halide arc discharge lamps of various wattage ratings in a novel manner. Understandably, it is contemplated that ratings for the individual circuit components being employed in the present circuitry can vary with the wattage rating of the specific lamp being operated. Similarly, it is contemplated that other already known breakover switch means can be substituted in said operating circuitry for the herein illustrated SIDAC devices. It is still further contemplated that utility of the present operating circuitry means can be extended to use with still other typical AC power sources in the approximate 100–125 volt rms range. Consequently, it is intended to limit the present invention only by the scope of the appended claims.

What I claim as new and desire to secure by Letters Patent of the United states is:

1. A metal halide arc discharge lamp connected in series with current-limiting induction means across a 120 volt AC power supply, said AC power supply providing a line voltage less than the voltage required to establish an arc condition in said lamp, starting circuit means connected in parallel across said arc discharge lamp enabling lamp ignition, and an auxiliary circuit network operatively associated therewith to automatically enable lamp reignition when needed during each half-cycle of the AC power supply, said auxiliary circuit network including breakover switching means connected in series with capacitor storage means across said discharge lamp, and with said capacitor storage means resonating with the current-limiting induction means at approximately the frequency of said AC power supply to supply the high voltage required for lamp reignition.

2. The lamp of claim 1 wherein the starting circuit means comprises pulse transformer means, second breakover switching means, a pair of capacitor storage means, and resistor charging means for one of said capacitor storage means.

3. The lamp of claim 2 wherein one of said capacitor storage means is connected in parallel across said arc discharge lamp.

4. The lamp of claim 2 wherein said second breakover switch means and one of said capacitor storage means are connected in a parallel manner via the pulse transformer means.

5. The lamp of claim 2 wherein the pulse transformer means is connected in series with the current limiting induction means intermediate a first input terminal of the AC power supply and a terminal of the arc discharge lamp connected thereto.

6. The lamp of claim 1 wherein the auxiliary circuit network is connected at one end to a second common circuit node which further connects to a first input terminal of the AC power supply and a pulse transformer means while having the other end of said auxiliary circuit network being connected to a second input terminal of the AC power supply.

7. The lamp of claim 6 wherein the breakover switching means in the auxiliary circuit network is connected at one end to the second common circuit node while being connected at the other end to a first terminal of the capacitor storage means in said auxiliary circuit network and with the second terminal of said capacitor storage means being connected to the second power supply terminal.

8. A metal halide arc discharge lamp connected in series with current-limiting induction means across a 120 volt AC power supply, starting circuit means connected in parallel across said arc discharge lamp enabling lamp ignition, and an auxiliary circuit network operatively associated therewith to automatically enable lamp reignition when needed during each half-cycle of the AC power supply, said auxiliary circuit network including breakover switching means connected in series with capacitor storage means across said discharge lamp, and with said capacitor storage means being connected for cooperation with the current-limiting induction means to supply the high voltage required for lamp reignition, wherein the starting circuit means comprises pulse transformer means, second breakover switching means, a pair of capacitor storage means, and resistor charging means for one of said capacitor storage means, and wherein the pulse transformer means is connected in series with the current limiting induction means intermediate a first input terminal of the AC power supply and a first input terminal of the arc discharge lamp connected thereto, the second breakover switching means and one of said capacitor storage means being each connected at one end in a parallel manner via the pulse transformer means while being each connected at the other end to a first common circuit node which further connects to one end of the resistor charging means and with the other end of said resistor charging means being serially connected to a second input terminal of the AC power supply which is further connected to a second input terminal of the arc discharge lamp.

9. The lamp of claim 8 wherein the capacitor storage means connected to the pulse transformer means is connected at one end to an intermediate tap terminal of said pulse transformer means while being connected at the other end to the first common circuit node.

10. The lamp of claim 8 wherein the other capacitor storage means in the starting circuit means is connected at one end to the first input terminal of the AC power supply while being connected at the other end to the second terminal of the AC power supply.

11. A metal halide arc discharge lamp connected in series with a current-limiting induction coil across a 120 volt AC power supply providing a line voltage less than the voltage required to effect glow-to-arc transition in said lamp, said lamp having first and second input terminals, starting circuit means connected to said first and second input terminals in parallel circuit relationship with said arc discharge lamp to enable lamp ignition, and an auxiliary circuit network also connected to said first and second input terminals in parallel circuit relationship with said arc discharge lamp to enable lamp reignition when needed during each half-cycle of the AC power supply, said auxiliary circuit network comprising a first bidirectional switching device connected in series with a first AC capacitor for resonating with the current-limiting induction coil at approximately the AC power supply frequency to automatically supply the high voltage required for lamp reignition when needed during each half-cycle of the AC power supply, and said starting circuit means comprising a pulse transformer, a second bidirectional switching device, and a second AC capacitor both being connected in parallel at one end to said pulse transformer while being connected in common at the opposite end to a charging resistor while still a third AC capacitor in said starting circuit is independently connected to said first and second input terminals of the AC power supply for parallel circuit relationship with said discharge lamp.

12. The lamp of claim 11 wherein both first and second bidirectional switching devices assume a non-conductive state so long as the lamp connected thereto operates in a stable arc mode condition thereby effectively removing the circuit components connected thereto from further circuit operation as a means for decreased energy utilization.

13. In a circuit comprising an arc discharge lamp connected in series with a current-limiting induction means across an a.c. power source supplying an a.c. line voltage less than the voltage required to establish an arc condition in said lamp by effecting a glow-to-arc transition of said lamp, wherein the improvement comprises:

a lamp reignition means comprising a capacitive means operatively connected to said induction means to resonate with said induction means at approximately the frequency of said a.c. line voltage to boost said a.c. line voltage to thereby establish an arc condition in said lamp by effecting a glow-to-arc transition of said lamp.

14. A circuit for operating an arc discharge lamp from an a.c. power source supplying a line voltage less than the voltage required to establish an arc condition in said lamp by effecting a glow-to-arc transition in said lamp, said circuit comprising:

a run circuit comprising a current-limiting induction means connected in series with said lamp across said a.c. power source; and a boost circuit operatively connected to said run circuit comprising a capacitive means resonating with said induction means at approximately the frequency of said a.c. power source to boost said a.c. line voltage to thereby establish an arc condition in said lamp by effecting a glow-to-arc transition in said lamp.

15. The circuit of claim 14 wherein said boost circuit further comprises a switching means to disconnect said boost circuit from said run circuit when an arc condition is established in said lamp.

16. A circuit comprising:

an arc discharge lamp;

an a.c. power source supplying an a.c. line voltage being less than the voltage required to effect a glow-to-arc transition of said lamp;

a current-limiting induction means connected in series with said lamp across said a.c. power source;

a lamp reignition means comprising a capacitive means operatively connected to said induction means to resonate with said induction means at about the frequency of said a.c. line voltage to provide the voltage required to effect glow-to-arc transition of said lamp.

17. The circuit of claim 16 wherein said reignition means is connected at one end to a circuit node between said induction means and a first terminal of said lamp and at the other end to a second circuit node common to a second terminal of said lamp and a first terminal of said a.c. power supply.

18. The circuit of claim 17 wherein said reignition means further comprises a breakover switching means connected in series with said capacitive means.

19. The circuit of claim 16 further comprising an ignitor means operatively connected to effect the initial high voltage breakdown condition of said lamp.

20. A circuit comprising:

an arc discharge lamp;

an a.c. power source supplying an a.c. line voltage being less than the voltage required to effect a glow-to-arc transition of said lamp;

a current-limiting induction means connected in series with said lamp across said a.c. power source;

a lamp reignition means comprising a capacitive means operatively connected to said induction means to resonate with said induction means at about the frequency of said a.c. line voltage to provide the voltage required to effect glow-to-arc transition of said lamp;

an ignitor means operatively connected to effect the initial high voltage breakdown condition of said lamp;

wherein said ignitor means comprises a pulse transformer means connected in series with the current limiting induction means intermediate a second terminal of the a.c. power supply and a first terminal of the arc discharge lamp connected thereto, a second breakover switching means and a second capacitive means being each connected at one end in a parallel manner via the pulse transformer means while being each connected at the other end to a third common circuit node which further connects to one end of a resistor charging means and with the other end of said resistor charging means being serially connected to a first input terminal of the a.c. power supply which is further connected to a second input terminal of the arc discharge lamp.

21. A method of boosting the a.c. line voltage of an inductively ballasted arc discharge lamp to effect glow-to-arc transition of said lamp, said method comprising the step of resonating a capacitive means with an inductive ballast at approximately the frequency of said a.c. line voltage, wherein said a.c. line voltage is less than the voltage required to effect glow-to-arc transition of said lamp.

22. A method operating an arc discharge lamp comprising the steps of:

(a) providing an arc discharge lamp;

(b) providing an a.c. power source supplying an a.c. line voltage less than the voltage required to effect glow-to-arc transition of said lamp;

(c) providing an inductive ballast connected in series with said lamp across said a.c. power source; and (d) boosting said a.c. line voltage by resonating a capacitive means with said inductive ballast at approximately the the frequency of said a.c. line voltage to thereby establish an arc condition in said lamp by effecting a glow-to-arc transition of said lamp.

23. The method of claim 22 further comprising the step of providing an ignitor means operatively connected to said lamp to effect the initial high voltage breakdown condition of said lamp.

24. The method of claim 22 further comprising the step of providing controlling means to prevent the boosting of said a.c. line voltage when an arc condition is established in said lamp and to effect the boosting of said a.c. line voltage when the arc condition is not established in said lamp.

25. The method of claim 24 wherein said controlling means comprises a breakover switching means connected in series with said capacitive means across said lamp.

* * * * *